US006196140B1

(12) United States Patent
Newhouse et al.

(10) Patent No.: US 6,196,140 B1
(45) Date of Patent: Mar. 6, 2001

(54) WORKSURFACE SYSTEM

(75) Inventors: Thomas J. Newhouse, Grand Rapids, MI (US); James R. Bruer; Scot Laughton, both of Toronto (CA); Gary T. Ottenjan, Comstock Park, MI (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 09/317,682

(22) Filed: May 24, 1999

Related U.S. Application Data

(60) Provisional application No. 60/087,982, filed on Jun. 3, 1998.

(51) Int. Cl.[7] ..... A47B 37/00

(52) U.S. Cl. ..... 108/50.01; 108/50.02; 108/147.11

(58) Field of Search ..... 108/50.01, 50.02, 108/144.11, 145, 147.11, 147; 312/223.6, 223.3, 196, 208.1; 52/36.1; 109/3

(56) References Cited

U.S. PATENT DOCUMENTS 3,701,506 * 10/1972 Favreau ..... 108/147.11 X
4,604,955 * 8/1986 Fleischer et al. ..... 108/147
4,852,500 * 8/1989 Ryburg et al. ..... 108/50.02 X
5,024,167 * 6/1991 Hayward ..... 108/50.02
5,174,223 * 12/1992 Nagy et al. ..... 108/50.01
5,322,025 * 6/1994 Sherman et al. ..... 108/147
5,323,695 * 6/1994 Borgman et al. ..... 108/147
5,398,622 * 3/1995 Lbinskas et al. ..... 108/3 X
5,673,632 * 10/1997 Sykes ..... 108/50.01 X
5,778,799 * 7/1998 Eyre ..... 108/147 X
5,868,079 * 2/1999 Charny ..... 108/147 X
5,967,631 * 10/1999 Ko ..... 108/50.01 X

* cited by examiner

*Primary Examiner*—Jose V. Chen
(74) *Attorney, Agent, or Firm*—Brinks Hofer Gilson & Lione

(57) ABSTRACT

A worksurface system is provided which includes a rear and front worksurface. The rear worksurface has a front edge and a rear edge. The front worksurface has a front edge adjacent a user of the system and a rear edge generally parallel and adjacent to the front edge of the rear worksurface. The rear worksurface is supported by a plurality of rear posts. A plurality of brackets, each connected to a rear post, support the front worksurface. These brackets are adapted to allow the front worksurface to be adjusted to different heights in relation to the rear worksurface.

15 Claims, 4 Drawing Sheets

71
69
17
63
61
65
19
67
54
56
14
13
16
34
20
15
36
31
18
91
87
23
43
85
75
73
77
47
58
54
45
17
19
41

WORKSURFACE SYSTEM

RELATED APPLICATION

This application claims the benefit of the filing date pursuant to 35 U.S.C. §119(e) of Provisional Application Ser. No. 60/087,982, filed Jun. 3, 1998, the disclosure of which is hereby incorporated by reference.

BACKGROUND OF THE INVENTION

The present invention relates to the field of office furniture and workspace management systems. More particularly, the invention relates to a worksurface system.

A worksurface system is a system for providing a surface, typically horizontal, for a person to work at. Many worksurface systems are available in the prior art, the most common being a simple table or desk. Another type of worksurface system is provided within a workspace management system by cantilevering a worksurface off of the partitions or wall units within the workspace management system.

SUMMARY OF THE INVENTION

Briefly stated, the invention is a worksurface system which includes a rear and front worksurface. The rear worksurface has a front edge and a rear edge. The front worksurface has a front edge adjacent a user of the system and a rear edge generally parallel and adjacent to the front edge of the rear worksurface. The rear worksurface is supported by a plurality of rear posts. A plurality of brackets, each connected to a rear post, support the front worksurface. These brackets are adapted to allow the front worksurface to be adjusted to different heights in relation to the rear worksurface.

In accordance with a preferred embodiment, the system also includes a plurality of height adjustable legs which further support the front work surface. This preferred embodiment also includes height adjustable screens which are cantilevered off the rear posts.

The present invention, together with attendant objects and advantages, will be best understood with reference to the detailed description below in connection with the attached drawings.

DETAILED DESCRIPTION OF THE PREFERRED EMBODIMENTS

Figure 1:
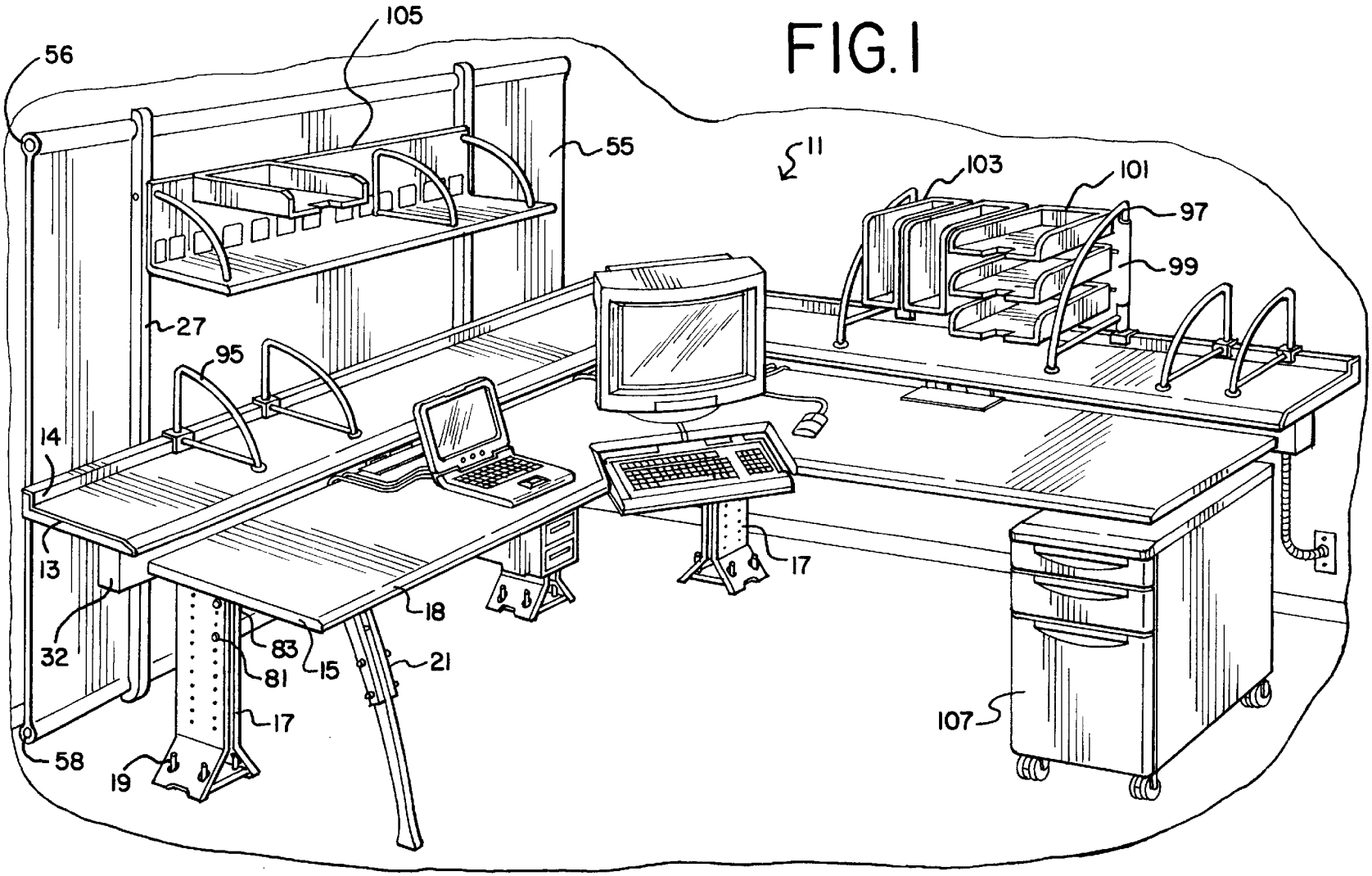
FIG. 1 is a perspective view of the preferred worksurface system of the present invention.

Referring to the drawings, FIG. 1 shows the preferred worksurface system 11 of the present invention. The system includes a rear worksurface 13 and a front worksurface 15. The rear worksurface is supported by a plurality of rear posts 17.

Figure 2:
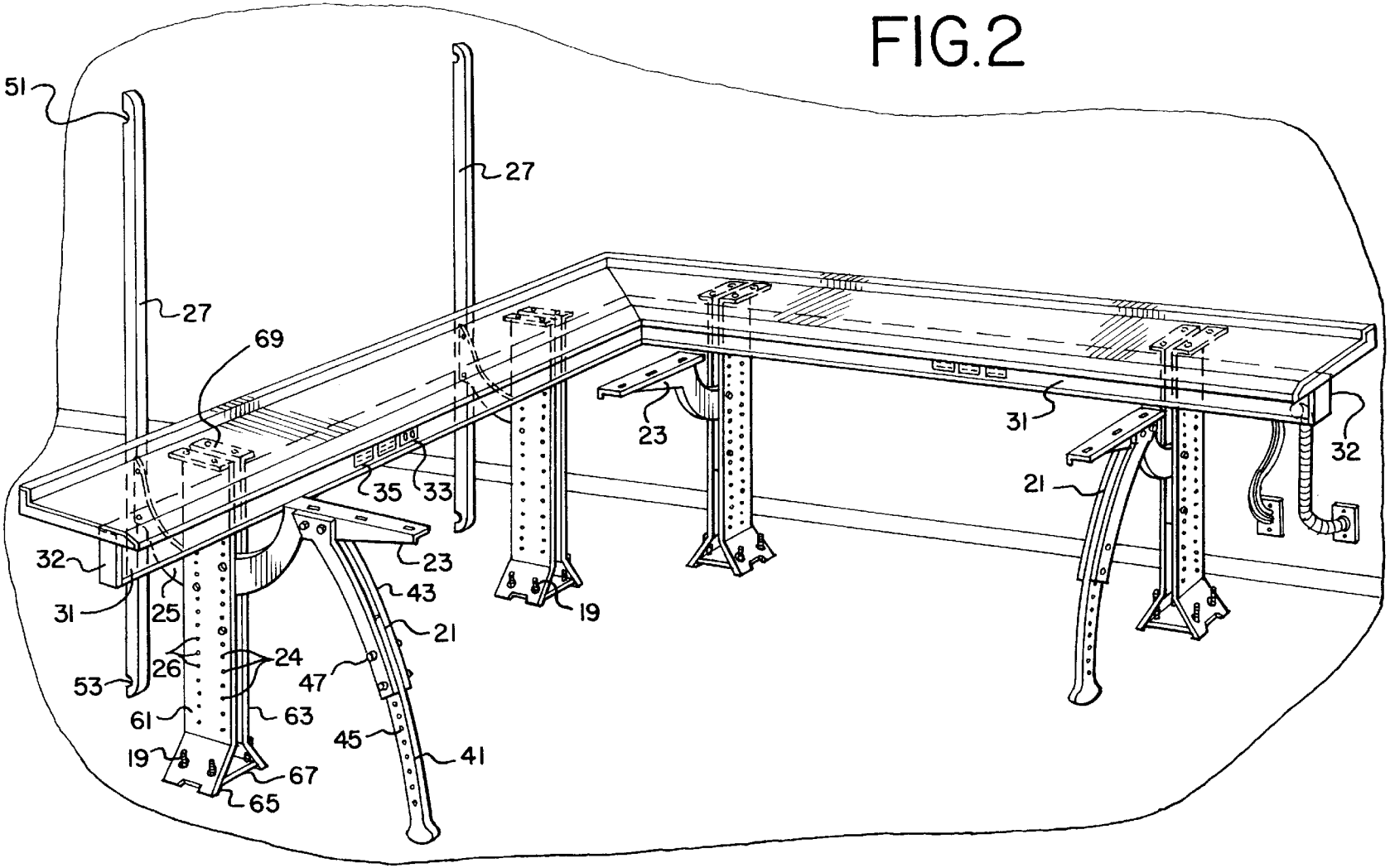
FIG. 2 is a view similar to FIG. 1 with the front worksurface and screen removed.
Figures 3, 4:
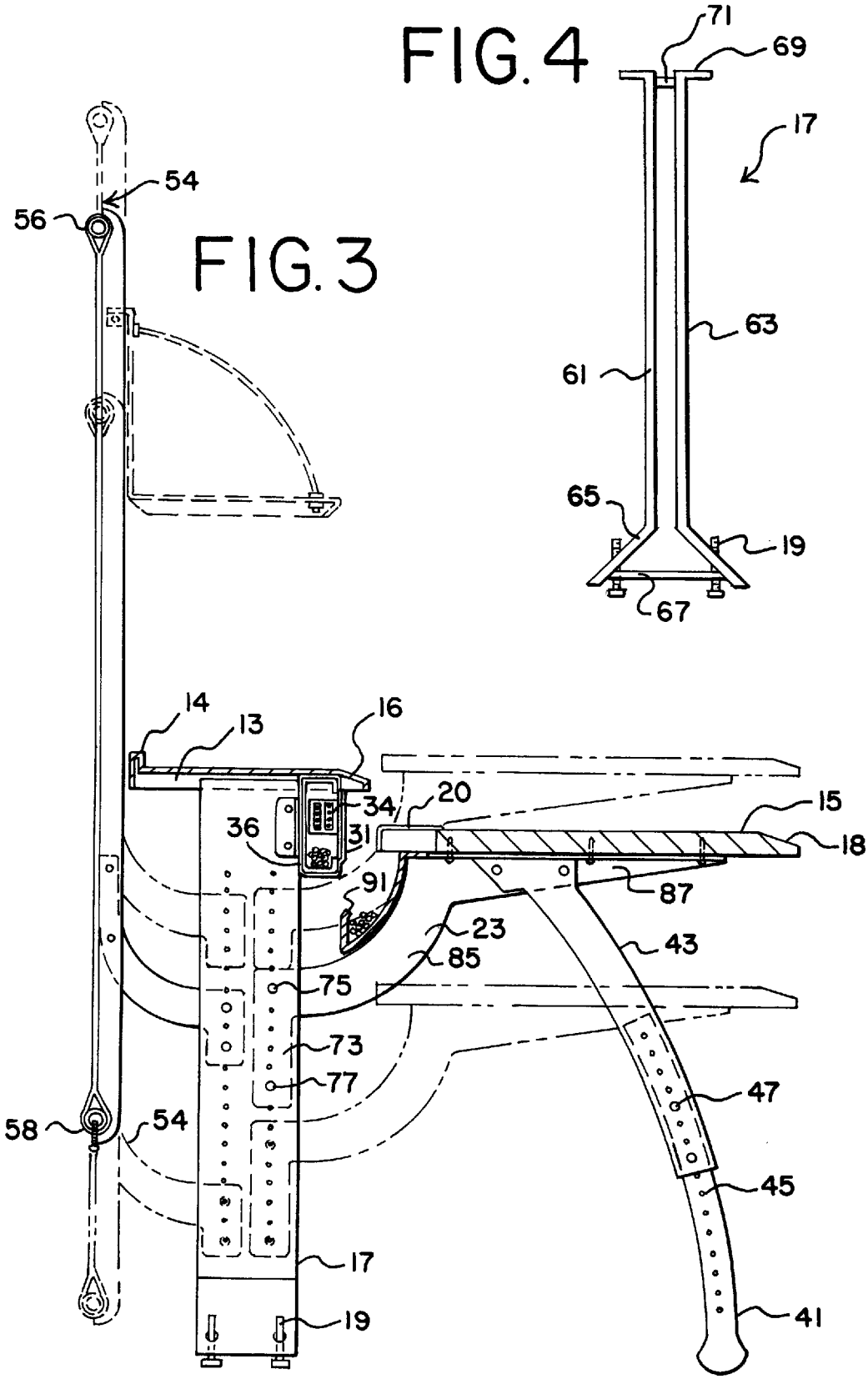
FIG. 3 is a side view showing the rear post and brackets.
FIG. 4 is a front view of a rear post.

As best seen in FIGS. 2 and 4, the preferred construction of the rear posts 17 is with a right side 61 and left side 63. Each side is made of a bent piece of metal with a front column of holes 24 and a rear column of holes 26 drilled therein. The bottom 65 of each side is angled away from the other side for stability. A bottom plate 67 is attached to hold the two sides together at the bottom. A spacer, not shown, is attached between the two sides to maintain a constant gap between the two sides. The top of each side includes a horizontal portion 69 with screw holes for attaching the rear worksurface 13.

The rear posts 17 preferably include a leveling device, most preferably four threaded height adjustment glides 19. Advantageously, the glides 19 include a slot or other feature on the top so as to make height adjustment relatively easy.

The rear worksurface 13 rests on top of the rear posts 17. Preferably, the rear worksurface 13 includes a rounded front edge 16 and a back ridge 14. Preferably, the front edge 16 is made of a pliable material to lessen the risk of fingers being pinched between it and the rear edge of the front worksurface. The back ridge 14 is used to mount tools such as the book ends 95 or tool stands 97. Tool stands 97, in turn, support a tool rail unit 99 on which items such as paper trays 101 and dividers 103 are mounted. The back ridge 14 is also beneficial in prevent small items from rolling or sliding off the back of the worksurface.

The front worksurface 15 also preferably includes a rounded front edge 18. Also, the rear edge 20 is preferably made of a pliable material to lessen the risk of fingers being pinched.

The front and rear worksurfaces are preferably made from medium density fiberboard (MDF) with some type of covering, preferably a laminate, although a veneer of wood or some other coating can be employed. Alternatively, the worksurfaces can be made from solid wood, bent metal, a molded or shaped plastic, or a composite material.

The overall shape of the front and rear worksurfaces can be generally rectangular. Preferably, both worksurfaces are L-shaped as shown in FIG. 1. Another way of looking at this is to see two rear and two front worksurfaces which are joined at a right angle with a 45° miter. In the most preferred embodiment shown in FIG. 1, the front worksurface 15 includes a cut-out for a keyboard tray 16 in the corner.

Figure 5A:
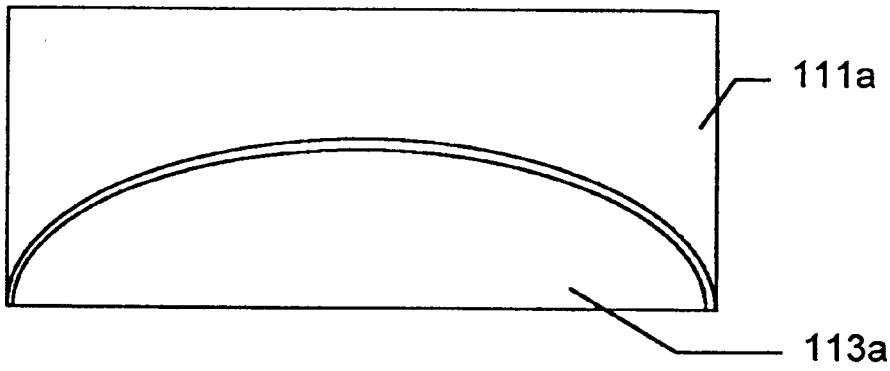
FIG. 5*a–c* are top views of worksurface systems showing front and rear worksurfaces of different shapes.
Figure 5B:
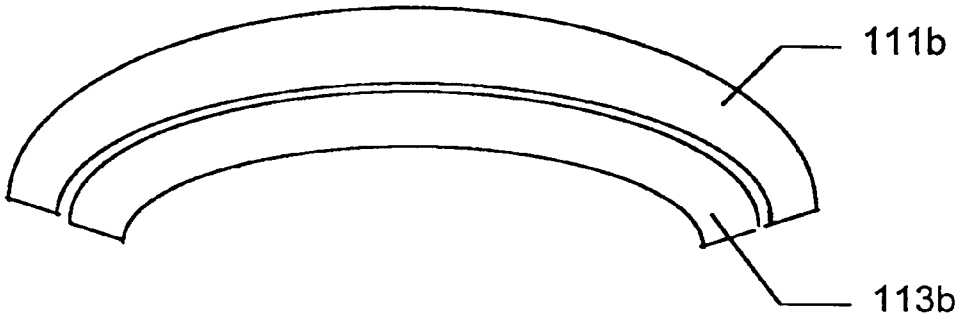
Figure 5C:
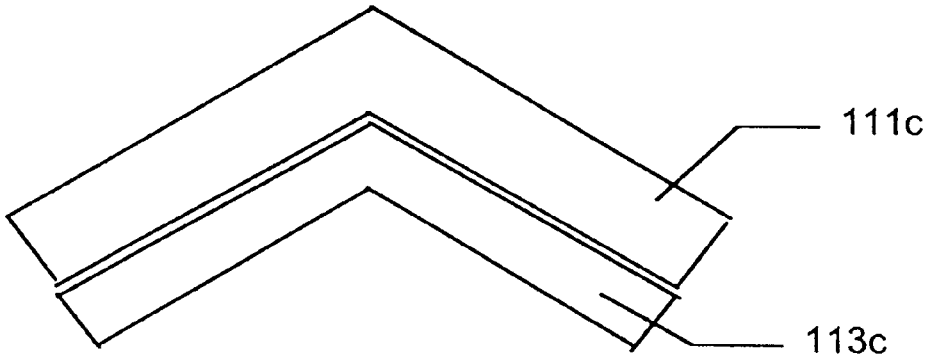

Alternative shapes, such as a C-shape, are also available, provided that the shape of the front edge of the rear worksurface is complimentary to the shape of the rear edge of the front worksurface. Some alternative shapes are shown in top view in FIGS. 5*a–c*, wherein 111*a–c* represent the rear worksurface and 113*a–c* represent the front worksurface.

As best seen in FIGS. 2 and 3, the front worksurface is supported by brackets 23 which are preferably cantilevered off the rear posts 17. The brackets 23 are configured to allow the front worksurface to be maintained at different heights relative to the rear worksurface. As shown by the dashed lines in FIG. 3, the front worksurface 15 can be adjusted to be above, below or even with the rear worksurface 13.

With the exception of adjustments to level the worksurface, the rear worksurface is preferably not height adjustable. Alternatively, height adjustment may also be built into the rear posts if desired.

The height adjustability of the front worksurface is a desirable feature in that it allows one to set the front worksurface at the optimum height depending on the size of the user and the type of task being performed. It is also seen as desirable to provide this height adjustability for the front worksurface independent of the height of the rear worksurface. For example, when the front worksurface is lower than the rear worksurface, it provides a "terraced" worksurface wherein objects placed on the rear worksurface, such as reference books, telephones, and the like, are physically above and visually separated from those on the front worksurface. As such, they are less likely to interfere with the worker's use of the front worksurface.

Two other benefits of being able to maintain the rear surface at the same height while adjusting the height of the front worksurface is improved office aesthetics and utilities sharing. Keeping all of the rear worksurfaces in an office at the same height provides a more orderly look to the office. Also, when utilities distribution is provided through the worksurface system, as will be explained in more detail below, it is important for the worksurfaces to line up vertically.

Preferably this height adjustability is accomplished by having the brackets 23 able to be connected at different heights along the post 17. Most preferably, this is accomplished through the series of holes 24 in the post 17. Most preferably, the bracket 23 includes a vertical portion 73 which fits in the gap between the two sides 61 and 63 of the rear post 17. This vertical portion 73 includes a top hole 75 and a bottom hole 77 which line up with holes 24 in both sides of the rear post. Top bolt 81 and bottom bolt 83 are inserted through two holes in the left side 63, through the holes 75 and 77 in the bracket 23 and through two holes in the right side 65. These bolts 81 and 83 may be secured in place by a nut on the end, by a cotter pin, by a biased pawl, or by any other releasable means.

The brackets 23 also preferably include an arcuate portion 85 and a horizontal portion 87. The horizontal portion preferably includes screw holes through which the screws 89 pass into the bottom of the front worksurface 15.

Preferably, the front worksurface is further supported by at least one leg 21. Most preferably, the legs 21 are attached to the horizontal portion 87 of the brackets 23 with bolts 24. Alternatively, the legs can be attached directly to the front worksurface.

The legs 21 are adapted to be height adjustable. Preferably, this is accomplished by providing a telescoping leg, i.e. a leg in at least two parts with one sliding within the other. Most preferably, the legs 21 comprise a top portion 43 which receives the bottom portion 41 in a cavity. Both portions 43 and 41 are preferably arcuate. The height adjustment is preferably made by passing a pair of bolts 47 through a pair of holes in the top portion 43 and through two holes 45 on the bottom portion 41.

Alternatively, the legs can be made height adjustable through other means. For example, the leg may be pivotably attached to the front worksurface so that, as the height of the front worksurface is changed, the angle between the leg and the floor can be changed. Also, the leg may be configured with a lower portion that is telescopically and threadably received within an upper portion.

A cabling trough 91 is preferably attached to and supported by the top of the arcuate portion 85 of the brackets 23. This trough 91 is open toward the top so that cables, such as computer cables or telephone lines, can be laid directly in. The trough 91 is preferably open on both ends for ready access. This trough 91 is intended to hold excess cabling, such as power cords and the like that would otherwise hang loose in an unsightly and possibly unsafe manner.

A cabling conduit 31 is preferably provided in the worksurface system 11. The conduit 31 is divided into at least two channels, one for power cabling 34 and another for data and/or communication cabling 36. Preferably, the power cabling is provided in a modular system such as that shown in U.S. Pat. No. 5,013,252. Fitted on the front surface of the conduit are outlets for power 35 and data/communication ports 33.

Preferably, the conduit 31 is openable from the front to provide access most preferably lay-in access, to both channels. The conduit 31 is preferably fitted with removable end caps 32. As a result, the conduit 31 may be either open or closed at the ends. It is desirable for the conduit 31 to be open at both ends when two or more worksurface systems are disposed adjacent one another so that cabling can be readily passed between the conduits. Alternatively, when a worksurface system is not adjacent another, it is desirable to have the ends of the conduit 31 be closed.

This conduit 31 is preferably attached to the front of the rear posts 17 just under the bottom of the rear worksurface 13. Alternatively, the conduit may be connected directly to the underside of the rear worksurface or to the brackets which support the front worksurface. Locating the conduit directly below and toward the front edge 16 of the rear worksurface 17 is desirable in that it is readily accessible through the gap between the rear and front worksurfaces, especially when the rear worksurface is higher than the front worksurface.

The worksurface system of the present invention is also preferably equipped with at least one screen 55. This screen 55 is supported by vertical standards 27, which are, in turn, supported by brackets 27 attached to the rear posts 17. The most preferable construction of the screens is a fabric sheet which encloses a top horizontal pole 56 and a bottom horizontal pole 58. The screen is attached to the standards 27 by placing the poles 56 and 58 in the semicircular grooves 51 and 53 respectively. Bolts 54 hold the poles in the grooves.

The screen 55 is preferably height adjustable. This is accomplished by configuring the brackets 25 to be attachable to the rear posts 17 at different heights. Most preferably, this is done with a column of holes 26 towards the rear of the posts 17. Alternatively, the bracket may be attached to the rear post at a fixed height and the standards be attachable to the brackets at different heights.

In addition to supporting the screen 55, the standards 27 also support overhead storage units, such as shelf 105. Alternatively, an overhead cabinet may be supported on the standards.

While other storage units may be attached to the worksurfaces, it is preferable to use a mobile, free-standing unit, such as the mobile pedestal unit shown at 107.

We claim:

1. A worksurface system comprising:

a rear worksurface with a front edge and a rear edge;

a front worksurface with a front edge adapted to be adjacent a user of the system and a rear edge generally parallel and adjacent to the front edge of the rear worksurface;

a plurality of rear posts supporting the rear worksurface from a floor;

a plurality of brackets, each connected to one of the rear posts and supporting the front worksurface, said brackets adapted to be attached at different heights along the rear posts thereby allowing the front worksurface to be adjusted to different heights in relation to the rear worksurface.

2. The system of claim 1 wherein the rear posts each include a series of holes at different heights and wherein the brackets for the front worksurface are adapted to index with the holes.

3. The system of claim 1 further comprising a cabling trough supported by the brackets.

4. A worksurface system comprising:

a rear worksurface with a front edge and a rear edge;

a front worksurface with a front edge adapted to be adjacent a user of the system and a rear edge generally parallel and adjacent to the front edge of the rear worksurface;

a plurality of rear posts supporting the rear worksurface from a floor;

a plurality of brackets, each connected to one of said rear posts and supporting the front worksurface, said brackets adapted to allow the front worksurface to be adjusted to different heights in relation to the rear worksurface;

at least one height-adjustable leg directly supporting the front worksurface from the floor.

5. The system of claim 4 wherein the leg comprises a telescoping upper portion attached to a bottom surface of the front worksurface and a bottom portion resting on a floor.

6. A worksurface system comprising:

a rear worksurface with a front edge and a rear edge;

a front worksurface with a front edge adapted to be adjacent a user of the system and a rear edge generally parallel and adjacent to the front edge of the rear worksurface;

a plurality of rear posts supporting the rear worksurface from a floor;

a plurality of brackets, each connected to one of said rear posts and supporting the front worksurface, said brackets adapted to allow the front worksurface to be adjusted to different heights in relation to the rear worksurface;

a utilities distribution member disposed beneath the rear worksurface, and wherein a gap between the front edge of the rear worksurface and the rear edge of the front worksurface allows for passage of cables therethrough.

7. The system of claim 6 wherein the member is attached to a bottom surface of the rear worksurface.

8. The system of claim 6 wherein the member is attached to the rear posts.

9. The system of claim 6 wherein the member includes an electrical power outlet.

10. The system of claim 6 wherein the member includes a data port.

11. The system of claim 6 wherein the member includes a conduit running the length of the rear worksurface.

12. The system of claim 11 wherein the power or data cabling can extend from the conduit of one worksurface system to the conduit of an adjacent like worksurface system.

13. A worksurface system comprising:

a rear worksurface with a front edge and a rear edge;

a front worksurface with a front edge adapted to be adjacent a user of the system and a rear edge generally parallel and adjacent to the front edge of the rear worksurface;

a plurality of rear posts supporting the rear worksurface from a floor;

a plurality of brackets, each connected to one of the rear posts and supporting the front worksurface, said brackets adapted to allow the front worksurface to be adjusted to different heights in relation to the rear worksurface;

a vertical screen supported behind the rear edge of the rear worksurface, wherein the screen is supported by at least one screen bracket connected to one of said rear posts.

14. The system of claim 13 wherein the screen bracket is adapted to be connected at different heights along the rear posts.

15. The system of claim 14 wherein the rear posts each include a first series of holes at different heights and wherein the brackets for the front worksurface are adapted to index with the first series of holes, and wherein the rear posts each further include a second series of holes at different heights and wherein the screen bracket is adapted to index with the second series of holes.

* * * * *